US008083222B2

(12) United States Patent
Nakano

(10) Patent No.: US 8,083,222 B2
(45) Date of Patent: Dec. 27, 2011

(54) STACKING APPARATUS, TRANSPORTATION APPARATUS AND RECORDING APPARATUS

(75) Inventor: Yoji Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/975,660

(22) Filed: Dec. 22, 2010

(65) Prior Publication Data

US 2011/0156339 A1 Jun. 30, 2011

(30) Foreign Application Priority Data

Dec. 25, 2009 (JP) ..... 2009-295468

(51) Int. Cl.
*B65H 3/52* (2006.01)

(52) U.S. Cl. ..... 271/121; 271/145

(58) Field of Classification Search ..... 271/121, 271/124, 19, 264, 145
See application file for complete search history.

(56) References Cited

U.S. PATENT DOCUMENTS

| | | | | |
|---|---|---|---|---|
| 7,000,916 | B2 * | 2/2006 | Asada et al. | 271/121 |
| 7,370,858 | B2 * | 5/2008 | Youn | 271/121 |
| 7,828,285 | B2 * | 11/2010 | Chu et al. | 271/167 |
| 2004/0245703 | A1 * | 12/2004 | Yun et al. | 271/110 |
| 2005/0051945 | A1 * | 3/2005 | Kang | 271/121 |
| 2008/0230979 | A1 * | 9/2008 | Asada et al. | 271/121 |

FOREIGN PATENT DOCUMENTS

| | | |
|---|---|---|
| JP | 2000-335769 | 12/2000 |
| JP | 3538569 | 6/2004 |

* cited by examiner

*Primary Examiner* — Jeremy R Severson
(74) *Attorney, Agent, or Firm* — Workman Nydegger

(57) ABSTRACT

A stacking apparatus includes: a cassette which accommodates a plurality of recording media in a superimposed manner; a mounting portion on which the cassette is mounted; a transportation path which is arranged at a downstream side in a direction in which the cassette is mounted on the mounting portion and on which the recording media are transported from the cassette mounted on the mounting portion; a stopper of which surface for regulating downstream side edges of the recording media regulates the side edges until the cassette is mounted on the mounting portion and of which surface for regulating the side edges of the recording media releases the regulation of the side edges with a rotational operation after the cassette is mounted on the mounting portion; and a slider which slides along a back surface of the regulating surface of the stopper for regulating the side edges.

7 Claims, 6 Drawing Sheets

STACKING APPARATUS, TRANSPORTATION APPARATUS AND RECORDING APPARATUS

BACKGROUND

1. Technical Field

The present invention relates to a stacking apparatus, a transportation apparatus and a recording apparatus.

2. Related Art

As a type of existing recording apparatus, there is an ink jet printer (hereinafter, referred to as "printer"). The printer performs printing as follows. An uppermost sheet is taken from a sheet feeding cassette (hereinafter, simply referred to as "cassette") on which a plurality of recording media (for example, a printing sheet, hereinafter, simply referred to as "sheet") are stacked so as to feed the sheet one by one to a recording portion (printing portion).

In such a printer, a mounting portion for mounting a cassette, and a sheet feeding roller for feeding a sheet are provided. After the cassette on which a plurality of sheets are stacked is mounted on the mounting portion, a sheet feeding operation is performed by rotating the sheet feeding roller. In the sheet feeding operation, an uppermost sheet arranged on the cassette is taken so as to be fed to a printing portion.

A face against which side edges of sheets accommodated in the cassette in a mounting direction thereof are abutted (abutment face) when the cassette is mounted on the mounting portion is set to be a slope in order to guide the plurality of sheets accommodated in the cassette to the recording portion while separating the plurality of sheets one by one. However, if the cassette is mounted roughly, sheets run up the slope (abutment face) in some case. Then, the plurality of sheets cannot be separated one by one. Therefore, double feeding of sheets may be caused. If the double feeding of sheets is caused, failures such as a paper jam may be caused.

On the other hand, a method of mounting the cassette gently such that the sheets do not run up the slope may be considered. However, in this case, a user has to be sensitive to the mounting beyond the necessary level and the method becomes not so preferable. Further, even when the cassette is gently mounted, the sheets can run up the slope in many cases.

Techniques for solving the above problem have been studied. For example, in Japanese Patent No. 3538569, a shutter member which is moved down from a retreated position at an upper side is provided in order to regulate side edges of sheets at a sheet feeding side. Further, when the shutter member is moved up to the retreated position at the upper side, a lower end portion of the shutter member is rotationally moved toward an upstream side in a sheet feeding direction. Therefore, the side edges of the sheets abutted against the shutter member can be sequentially aligned in a tilted state in which a side edge of the uppermost sheet is at the most advanced position in the sheet feeding direction.

However, in Japanese Patent No. 3538569, the shutter member is rotationally moved and slid to the retreated position. Therefore, an additional space for providing a rotational mechanism and a sliding mechanism is required. In addition, spaces for accommodating the shutter member, the rotational mechanism and the sliding mechanism in the retreated position are required. Accordingly, an apparatus is increased in size.

SUMMARY

An advantage of some aspects of the invention is to provide a stacking apparatus, a transportation apparatus, and a recording apparatus in which a cassette can be mounted without requiring a user to be sensitive and an edge of a sheet can be regulated and which can be reduced in size.

A stacking apparatus according to a first aspect of the invention includes: a cassette which accommodates a plurality of recording media in a superimposed manner; a mounting portion on which the cassette is mounted; a transportation path which is arranged at a downstream side in a direction in which the cassette is mounted on the mounting portion and on which the recording media are transported from the cassette mounted on the mounting portion; a stopper of which surface for regulating downstream side edges of the recording media regulates the side edges until the cassette is mounted on the mounting portion and of which surface for regulating the side edges of the recording media releases the regulation of the side edges with a rotational operation after the cassette is mounted on the mounting portion; and a slider which slides along a back surface of the regulating surface of the stopper for regulating the side edges.

In the stacking apparatus, the collision energy of the recording media against the stopper is absorbed with a timelag. That is to say, even when the cassette is mounted roughly, the recording media do not run up the transportation path on which the recording media are transported one by one due to the impetus of mounting operation. Accordingly, the cassette can be mounted without requiring a user to be sensitive and the side edges of the recording media can be regulated. As a result, the stacking apparatus having high reliability in which double feeding of the recording media can be prevented and failures such as a sheet jam are suppressed from being caused can be provided.

Further, a space can be effectively used in comparison with a case where the slider is slid while a surface which is different from the back surface of the stopper (for example, a surface of the mounting portion on which the cassette is mounted) is set as a base surface. Accordingly, the apparatus can be reduced in size.

In addition, it is preferable that a first comb-tooth shape be provided on a back surface of the regulating surface of the stopper for regulating the side edges and a second comb-tooth shape which engages with the first comb-tooth shape be provided on a surface of the slider at a side opposed to the stopper.

In the stacking apparatus, an area where the slider and the stopper are in contact with each other becomes large. That is to say, when the slider slides along the back surface of the stopper, a high frictional force acts on the contact surface between the slider and the stopper. Therefore, the contact surface between the slider and the stopper functions as a friction damper so that the collision energy of the recording media against the stopper is absorbed with a timelag. Accordingly, the cassette can be mounted without requiring a user to be sensitive and the side edges of the recording media can be reliably regulated.

Further, it is preferable that a viscous material be arranged between surfaces of the stopper and the slider, which are opposed to each other.

In the stacking apparatus, the contact surface between the slider and the stopper functions as an oil damper. In the configuration, the cassette can be mounted without requiring a user to be sensitive and the side edges of the recording media can be reliably regulated.

Further, it is preferable that the surface of the stopper for regulating the side edges be subjected to a high friction processing.

In the stacking apparatus, the recording media do not easily run up the surface of the stopper in comparison with a case in which the surface of the stopper is not subjected to any processing. Accordingly, the cassette can be mounted without requiring a user to be sensitive and the edges of the recording media can be reliably regulated.

Further, it is preferable that the stopper be provided at a position corresponding to a center portion of the side edges in an extension direction of the side edges.

In the stacking apparatus, the collision energy of the recording media against the stopper uniformly acts on both the right side and the left side of the edges of the recording media without being biased to one side. That is, the collision energy of the recording medium against the stopper is absorbed at the center portion of the edges in a concentrated manner. Therefore, the edges of the recording media can be stably regulated.

Further, it is preferable that a plurality of stoppers be provided so as to be parallel with the extension direction of the side edges of the recording media.

In the stacking apparatus, collision energy of the recording media against each stopper uniformly acts on both the right side and the left side of the edges of the recording media without being biased to any side. That is, the collision energy of the recording media against the stopper is absorbed at the right side and the left side of the side edges in a dispersed manner. Therefore, the edges of the recording media can be reliably and stably regulated.

A transportation apparatus according to another aspect of the invention includes the stacking apparatus according to the above aspect of the invention and a transportation roller which transports the recording media transported from the stacking apparatus.

In the transportation apparatus, the stacking apparatus according to the above aspect of the invention is included. Therefore, a transportation apparatus in which the cassette can be mounted without requiring a user to be sensitive and the side edges of the recording media can be reliably regulated and which can be reduced in size can be provided.

Further, a recording apparatus according to still another aspect of the invention uses the transportation apparatus according to the above aspect of the invention as a transportation portion and includes a recording portion which performs a recording processing on the recording media transported by the transportation portion.

In the recording apparatus, the transportation apparatus according to the above aspect of the invention is included. Therefore, a recording apparatus in which the cassette can be mounted without requiring a user to be sensitive and the side edges of the recording media can be reliably regulated and which can be reduced in size can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to drawings. Such embodiment illustrates an aspect of the invention and is not intended to limit the invention. The embodiment can be arbitrarily changed within a range of technical spirit of the invention. Further, in the following drawings, scales and the number of components in each configuration are different from those in the practical configuration for making each configuration to be understood easily.

Figure 1:
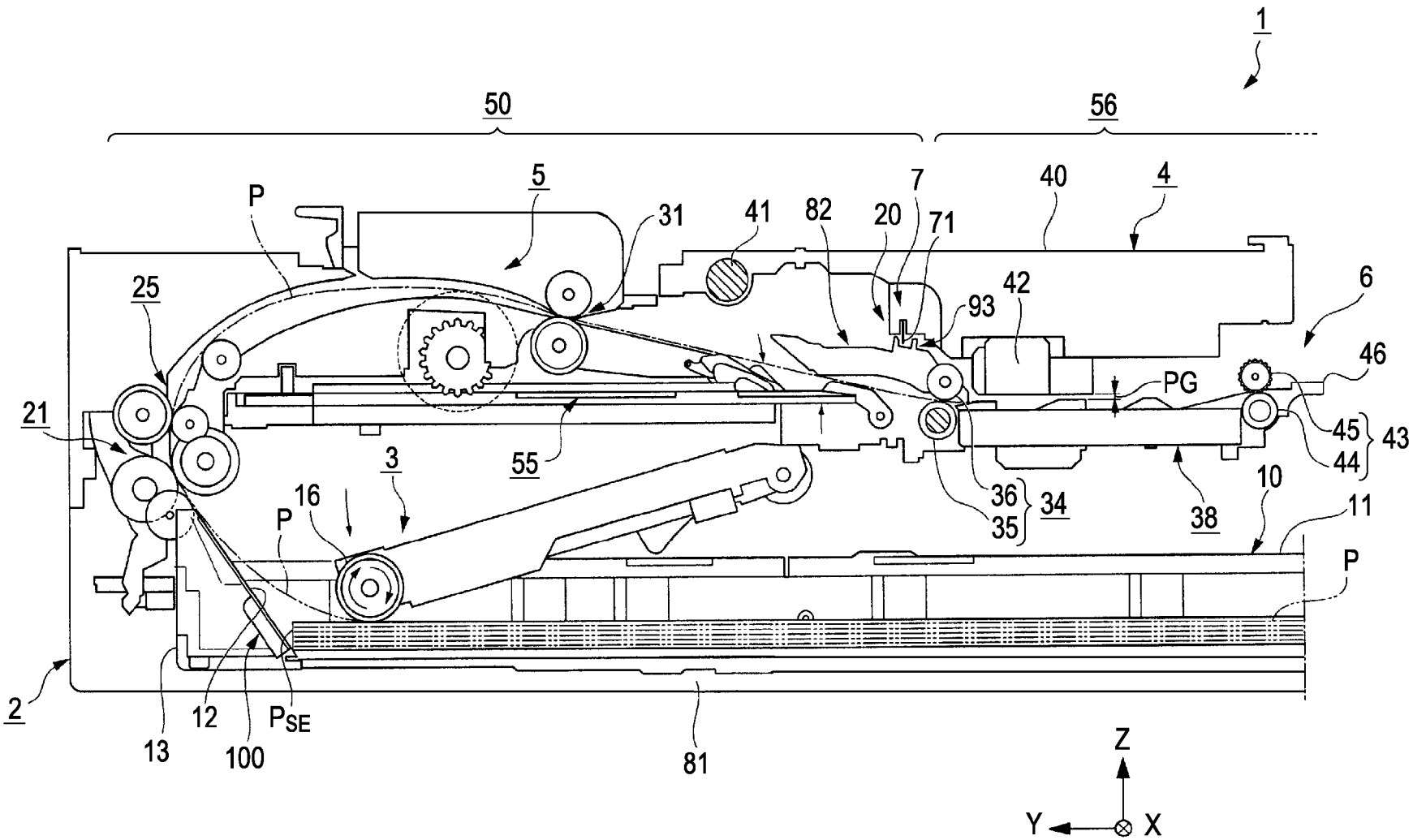
FIG. 1 is a cross-sectional view illustrating an internal configuration of a recording apparatus according to the invention.

FIG. 1 is a cross-sectional view illustrating an internal configuration of a recording apparatus according to the invention. Hereinafter, an ink jet printer (hereinafter, referred to as "printer") is described as an example of the recording apparatus.

As shown in FIG. 1, a recording apparatus 1 according to the embodiment is a printer on which a recording head 42 is mounted on a lower surface of a carriage 40. The carriage 40 can reciprocate in a width direction X perpendicular to a transportation direction Y in a recording execution region 56.

Hereinafter, description is given based on an XYZ orthogonal coordinate system shown in FIG. 1. In the XYZ Cartesian coordinate system, an XY flat surface is set to be a surface parallel with a horizontal surface and a Z direction is set to a vertical direction. At this time, a transportation direction (discharge direction) of sheets P may be referred to as a Y direction and a width direction of a transportation path may be referred to as an X direction. Further, a downstream side and an upstream side in the transportation direction of the recording media (for example, a printing sheet, hereinafter, simply referred to as "sheet") P are set based on a direction in which the sheets P are fed.

The recording apparatus 1 includes a printer main body 2, a stacking apparatus 10 which accommodates a plurality of sheets P, a feeding apparatus 3 which feeds the sheets P, a recording portion 4 which performs a recording processing on the sheets P, a transportation apparatus 5 which transports the sheets P along the transportation direction, an encoder apparatus 7 which detects a position of the carriage 40, a discharge apparatus 6 which discharges the sheets P, and a controller (not shown) which controls operations of each of constituent apparatuses overall.

The stacking apparatus 10 includes a cassette 11, a mounting portion 13, a separation slope 12 (which is a transportation path on which recording media are transported one by one) 12, a regulation unit 100. The cassette 11 accommodates a plurality of sheets P in a superimposed manner. The cassette 11 is mounted on the mounting portion 13. The separation slope 12 is arranged at a downstream side of the cassette 11 in a direction in which the cassette 11 is mounted on the mounting portion 13. Further, the sheets P are transported one by one from the cassette 11 mounted on the mounting portion 13 on the separation slope 12. The regulation unit 100 regulates side edges $P_{SE}$ of the sheets P accommodated in the cassette 11 in a mounting direction (−Y direction) thereof when the cassette 11 is mounted on the mounting portion 13. Further, the regulation unit 100 releases the regulation of the side edges $P_{SE}$ of the sheets P with a timelag after the cassette 11 is mounted on the mounting portion 13. It is to be noted that a configuration of the regulation unit 100 will be described later (see, FIG. 2).

The feeding apparatus 3 includes a pickup roller 16, separation rollers 21 and intermediate transportation rollers 25, 31. The pickup roller 16 sequentially feeds the uppermost sheet from the sheets P accommodated in the cassette 11. The separation rollers 21 completely separate subsequent sheets P from the uppermost sheet P, which is not separated, when the fed uppermost sheet P is introduced to a U-shaped inverted path 50 while being separated. The intermediate transportation rollers 25, 31 transport the sheet P along the U-shaped inverted path 50.

The transportation apparatus 5 includes the above-described stacking apparatus 10, a unit frame 81, a transportation roller 34, a transportation driven roller holder 82, a tray 55, and the like. The transportation roller 34 is formed by a nip roller including a transportation driving roller 35 and a transportation driven roller 36. The stacking apparatus 10, the transportation driving roller 35, the transportation driven roller holder 82, and the tray 55 are attached to the unit frame 81. Further, a platen 38 which supports a transportation posture of the sheet P is provided on the unit frame 81.

The transportation driven roller 36 is axially supported by the transportation driven roller holder 82 at a plurality of points. A plurality of biasing springs (not shown) are connected to the transportation driven roller holder 82. With elastic forces by the biasing springs, the transportation driven roller 36 is biased to the side of the transportation driving roller 35 all the time.

The recording portion 4 includes the recording head 42 and the carriage 40. The recording head 42 performs a recording processing on the sheet P. The recording head 42 is mounted on the carriage 40. The recording head 42 is mounted on a bottom of the carriage 40 which holds an ink cartridge (not shown). At this time, the recording head 42 is arranged so as to be opposed to the platen 38 in the vertical direction. The platen 38 is provided at the downstream side (−Y direction side) with respect to the transportation roller 34. A predetermined recording is performed on the sheet P supplied onto the platen 38 by the transportation roller 34.

The carriage 40 is supported by a carriage guiding shaft 41 attached to the above-described unit frame 81. The carriage 40 is connected to a carriage motor through a timing belt (not shown). Therefore, when the carriage motor is driven, the carriage 40 is reciprocated in the X direction along the carriage guiding shaft 41. Further, the carriage 40 vertically moves in the Z direction with respect to the platen 38 (sheet P) while being supported by the carriage guiding shaft 41 as a supporting shaft. With this, a gap (platen gap PG) between the platen 38 and the recording head 42 can be changed depending on the thickness of the sheet P or the like. In addition, the ink cartridge (not shown) is detachably attached to the carriage 40. Ink in the ink cartridge is fed to the recording head 42.

Further, the recording portion 4 includes a plurality of ink tubes and ink supply pumps (not shown) which supply each color of ink to the recording head 42 and a capping device (not shown) which is provided at a home position of the carriage 40.

The encoder apparatus 7 detects the position of the carriage 40 in a scanning direction. The encoder apparatus 7 includes an encoder scale 71 on which a predetermined pattern is formed and a detection sensor 20 which optically detects the pattern of the encoder scale 71.

The encoder scale 71 is provided in the unit frame 81 described above in a tension manner so as to be extended in the width direction X perpendicular to the transportation direction Y of the sheet P. A predetermined pattern in which light shielding portions and light transparent portions are alternately arranged over the extending direction of the encoder scale 71 is formed on the encoder scale 71.

The detection sensor 20 is integrally provided at a rear face side of the carriage 40. The detection sensor 20 moves following the carriage 40 so as to read the predetermined pattern formed on the encoder scale 71 and detect a movement amount of the carriage 40. For example, an optical sensor or a magnetic sensor can be used as the detection sensor 20.

The discharge apparatus 6 includes a discharge roller 43 and a discharge stacker 46.

The discharge roller 43 is formed by a nip roller including a discharge driving roller 44 and a discharge driven roller 45. Then, the sheet P transported by the above-described operation of the transportation roller 34 is supplied to a nip point of the discharge roller 43 through the platen 38. The discharge driving roller 44 is connected to a driving motor which is the same as that of the above described transportation driving roller 35. The discharge driving roller 44 and the transportation driving roller 35 operate in conjunction with each other.

The discharge stacker 46 stacks sheets P which have been subjected to the recording processing in a superimposed state. The discharge stacker 46 is provided at an upper side of the mounting surface of the cassette 11. Further, an extension stacker (not shown) is accommodated in the discharge stacker 46 in such a manner that the extension stacker can be drawn or stored.

In the recording apparatus 1 having such configuration, the cassette 11 is mounted on the mounting portion 13 and the side edges $P_{SE}$ of the plurality of sheets P accommodated in the cassette 11 are aligned by the above-described regulation unit 100. Thereafter, a single sheet P supplied to the U-shaped inverted path 50 by the pickup roller 16 is supplied to the nip point of the transportation roller 34 through the U-shaped inverted path 50 by feeding and guiding operations of the separation rollers 21, and the intermediate transportation rollers 25, 31. The transportation roller 34 is provided in the vicinity of the downstream position on the U-shaped inverted path 50. The platen 38 and the recording head 42 are arranged at the downstream side (−Y direction side) of the transportation roller 34 so as to be opposed to each other in the vertical direction. When the sheet P is supplied to the platen 38 by rotation of the transportation driving roller 35 and transported to a position at which the sheet P is opposed to the recording head 42, the recording processing by the recording head 42 is performed on the sheet P. The sheet P on which the recording processing has been performed is fed to the discharge stacker 46 by the discharge roller 43.

A face against which side edges of sheets accommodated in the cassette in the mounting direction thereof are abutted (abutment face) when the cassette is mounted on the mounting portion is set to be a slope in order to guide the plurality of sheets accommodated in the cassette to the recording portion while separating the plurality of sheets one by one. However, if the cassette is mounted roughly, sheets run up the slope (abutment face) in some case. Then, the plurality of sheets cannot be separated one by one. Therefore, double feeding of sheets may be caused. As the result of the double feeding, failures such as a paper jam have occurred.

Then, in the recording apparatus 1 according to the invention, the side edges $P_{SE}$ of the sheets P are regulated so as not to run up the slope by providing the regulation unit 100. The regulation unit 100 regulates the side edges $P_{SE}$ of the sheets P accommodated in the cassette 11 in the mounting direction (−Y direction) thereof when the cassette 11 is mounted on the mounting portion 13. Further, the regulation unit 100 releases the regulation of the side edges $P_{SE}$ of the sheets P with a timelag after the cassette 11 is mounted on the mounting portion 13. It is to be noted that the regulation unit 100 will be described below in detail with reference to FIG. 2 and FIG. 3.

Figure 2:
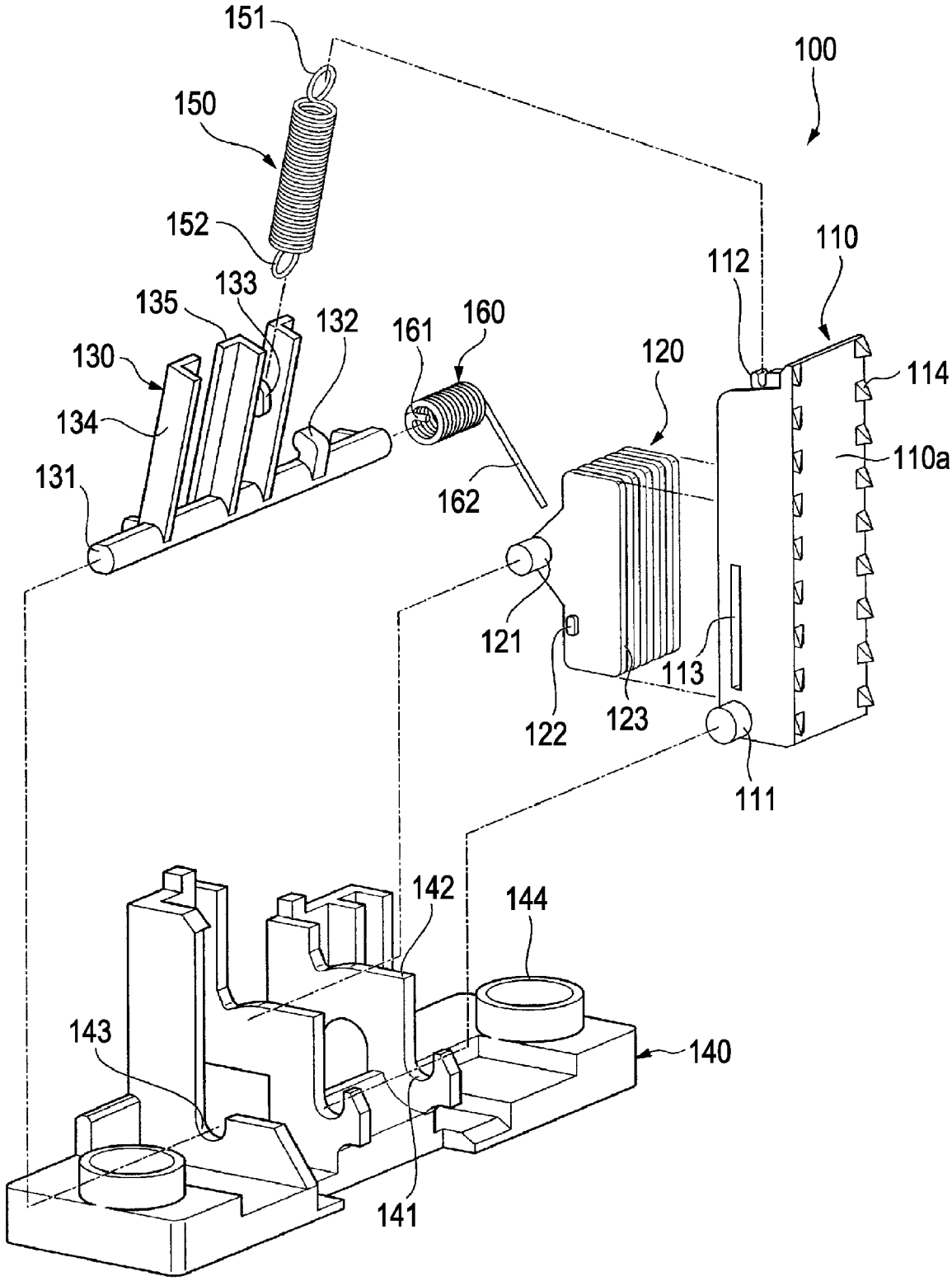
FIG. 2 is an exploded perspective view illustrating a schematic configuration of a regulation unit.
Figure 3:
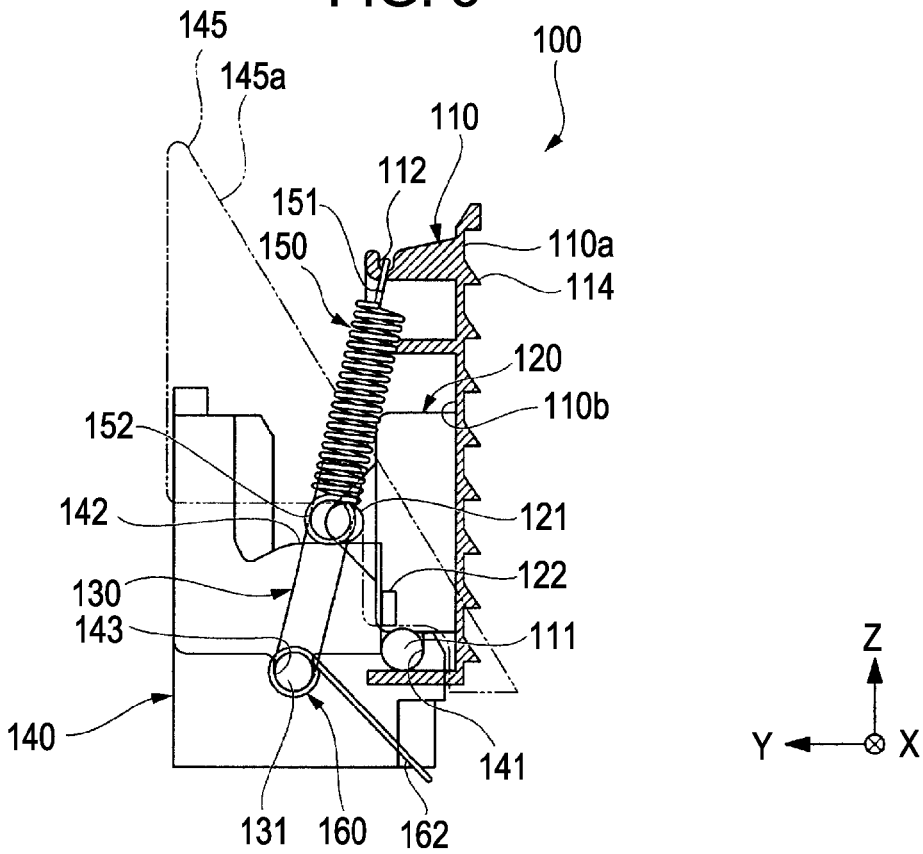
FIG. 3 is a cross-sectional view illustrating an arrangement state of the regulation unit.
Figure 4:
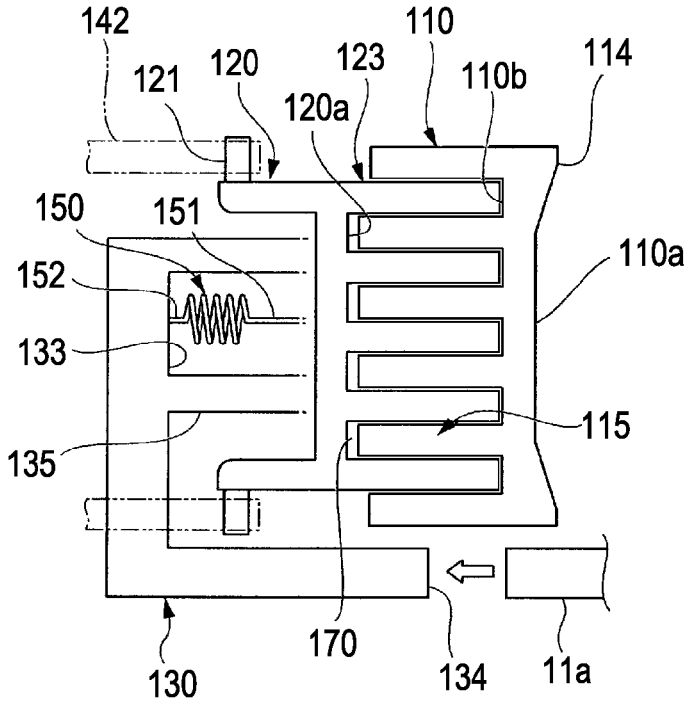
FIG. 4 is a partial cross-sectional view illustrating an arrangement state of the regulation unit.

FIG. 2 is an exploded perspective view illustrating a schematic configuration of the regulation unit 100. FIG. 3 is a cross-sectional view illustrating an arrangement state of the regulation unit 100. FIG. 4 is a partial cross-sectional view illustrating an arrangement state of the regulation unit 100.

As shown in FIG. 2, the regulation unit 100 includes a stopper 110, a slider 120, a lever 130, a base 140, a base cover 145 (see, FIG. 3), a coil spring 150, and a torsion spring 160.

A stopper rotational shaft 111 which is extended in the X direction and a slide hole 113 are provided at a side face of the stopper 110. As shown in FIG. 3, the stopper rotational shaft 111 abuts against a U-shaped concave 141 provided on the base 140. Further, a hook portion 112 for fixing an end 151 of the coil spring 150 is provided at an upper end of the stopper 110. On the other hand, the other end 152 of the coil spring 150 is fixed to a hook portion 133 provided on the lever 130. Therefore, the stopper 110 is moved rotationally about the stopper rotational shaft 111. Further, the slide hole 113 is provided so as to extend in parallel with a longitudinal direction of the stopper 110. A projection 122 of the slider 120 is inserted into the slide hole 113 so that the slider 120 slides.

In addition, a surface 110*a* of the stopper 110, which regulates the side edges $P_{SE}$, is subjected to a high friction processing. To be more specific, a plurality of convexes 114 are provided on the surface 110*a* of the stopper 110. With the convexes 114, even when the sheets P hit the surface 110*a* of the stopper 110 at a high speed, the sheets do not run up the surface 110*a* of the stopper 110 easily. It is to be noted that the high friction processing is not limited to the configuration in which the plurality of convexes 114 are provided on the surface 110*a* of the stopper 110 and can be arbitrarily set. For example, a configuration in which an elastic member such as a rubber member is provided can be employed depending on the necessity. Further, a first comb-tooth shape 115 is formed on a back surface 110*b* of the stopper 110, which is an opposite side to the surface which regulates the side edges $P_{SE}$ (see, FIG. 4).

The stopper 110 regulates the side edges $P_{SE}$ of the sheets P accommodated in the cassette 11 in the mounting direction (−Y direction) thereof when the cassette 11 is mounted on the mounting portion 13. Further, the stopper 110 releases the regulation of the side edges $P_{SE}$ of the sheets P with a timelag after the cassette 11 is mounted on the mounting portion 13. To be more specific, the stopper 110 rotates from a standing state where the surface 110*a* of the stopper 110 is perpendicular to the mounting direction Y of the sheets P to a tilted state where the surface 110*a* is parallel with the separation slope 12. That is, the surface 110*a* of the stopper 110 rotates from the standing state before the side edges $P_{SE}$ of the sheets P are regulated to the tilted state after the regulation of the side edges $P_{SE}$ of the sheets P is released.

A slider rotational shaft 121 which is extended in the X direction and the projection 122 are provided on a side face of the slider 120. The slider rotational shaft 121 abuts against a cam 142 formed by fitting the base 140 and the base cover 145 to each other. The cam 142 converts the rotation operation of the stopper 110 to a linear movement through the slider 120. Further, the projection 122 slides along the slide hole 113 of the stopper 110. Therefore, the slider 120 moves in conjunction with the rotational operation of the stopper 110 and slides along the back surface 110*b* of the stopper 110 through the cam which converts the rotational operation of the stopper 110 to the linear movement.

As shown in FIG. 4, a second comb-tooth shape 123 is provided on a surface 120*a* of the slider 120, which is opposed to the back surface 110*b* of the stopper 110. The second comb-tooth shape 123 engages with the above-described first comb-tooth shape 115. The first comb-tooth shape 115 and the second comb-tooth shape 123 are formed in an alternate manner. An area where the slider 120 and the stopper 110 are in contact with each other becomes large by providing the first comb-tooth shape 115 and the second comb-tooth shape 123 in such a manner. Therefore, when the slider 120 slides along the back surface 110*b* of the stopper 110, a high frictional force acts on the contact surface of the slider 120 and the stopper 110. Accordingly, the contact surface of the slider 120 and the stopper 110 functions as a friction damper. That is to say, the stopper 110 rotates from the standing state to the tilted state with a timelag.

Further, a viscous material 170 is arranged between the back surface 110*b* of the stopper 110 and the surface 120*a* of the slider 120 which is opposed to the back surface 110*b* of the stopper 110. For example, grease or the like can be used as the viscous material 170. With the viscous material 170, the contact surface between the slider 120 and the stopper 110 functions as an oil damper. That is to say, the stopper 110 rotates from the standing state to the tilted state with a timelag.

It is to be noted that the viscous material 170 is not limited to the grease and various viscous materials can be used depending on the necessity. Further, in the embodiment, the friction damper and the oil damper are described as examples. However, the invention is not limited thereto and other configurations can be appropriately used if necessary as long as the configurations have a damper mechanism.

As shown in FIG. 2 and FIG. 3, a lever rotational shaft 131 which is extended in the X direction is provided at a lower end of the lever 130. The lever rotational shaft 131 abuts against a U-shaped concave 143 provided on the base 140. Further, a hook portion 132 for fixing one end 161 of the torsion spring 160 is provided on the lever rotational shaft 131. On the other hand, the other end 162 of the torsion spring 160 is fixed to the base 14. With this, the lever 130 is operated rotationally about the lever rotational shaft 131. Further, the hook portion 133, a reception portion 134 and a stay portion 135 are provided on the lever 130. The hook portion 133 is a portion for fixing the other end 152 of the coil spring 150. A convex 11*a* (see, FIG. 5A) provided on the cassette 11 at the +Y direction side abuts against the reception portion 134. The stay portion 135 holds the stopper 110 to be in the standing state.

The U-shaped concave 141, the cam 142, the U-shaped concave 143 and fixing holes 144 are provided on the base 140. The stopper rotational shaft 111 abuts against the U-shaped concave 141. The slider rotational shaft 121 abuts against the cam 142. The lever rotational shaft 131 abuts against the U-shaped concave 143. The fixing holes 144 fix the base 140. The base cover 145 is fitted into the base 140. That is to say, upper portions of the U-shaped concave 141 and the cam 142 are covered by the base cover 145. With this configuration, the stopper rotational shaft 111 and the slider rotational shaft 121 abut against the base cover 145 so that the rotational shafts are regulated so as not to advance from the abutment position in the Z direction. Further, the surface 145*a* of the base cover 145 is formed to be substantially the same surface as the separation slope 12.

The base 140 is fixed by inserting insertion pins (not shown) provided in the vicinity of the separation slope 12 of the above-described mounting portion 13 into two fixing holes 144. It is to be noted that the fixing position of the base 140 is not limited to the position on the mounting portion 13 side and may be set to a position on the cassette 11 side. In this case, insertion pins (not shown) are provided in the vicinity of the side edges $P_{SE}$ of the cassette 11 and inserted into the fixing holes 144 so that the base 140 is fixed.

In such a manner, the regulation unit 100 according to the invention is provided so as to be integrated with a mechanism which rotationally operates the stopper 110 and a mechanism which slides the slider 120. That is, unlike the configuration disclosed in Japanese Patent No. 3538569 in which a shutter member is rotationally moved and slid to the retreated position, spaces for providing the rotational mechanism and the sliding mechanism are not required. Further, spaces for accommodating the shutter member, the rotational mechanism and the sliding mechanism in the retreated position are not required.

Figure 5A:
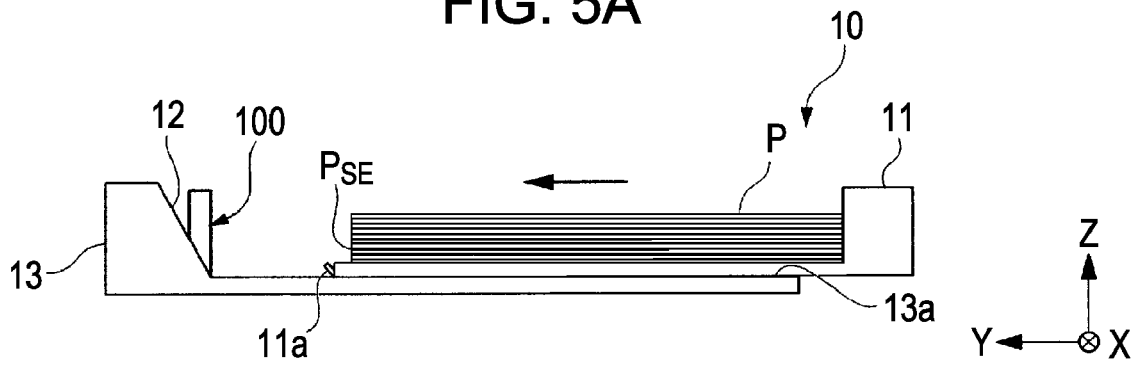
FIGS. 5A to 5C are views illustrating a set state of sheets using the regulation unit.
Figure 5B:
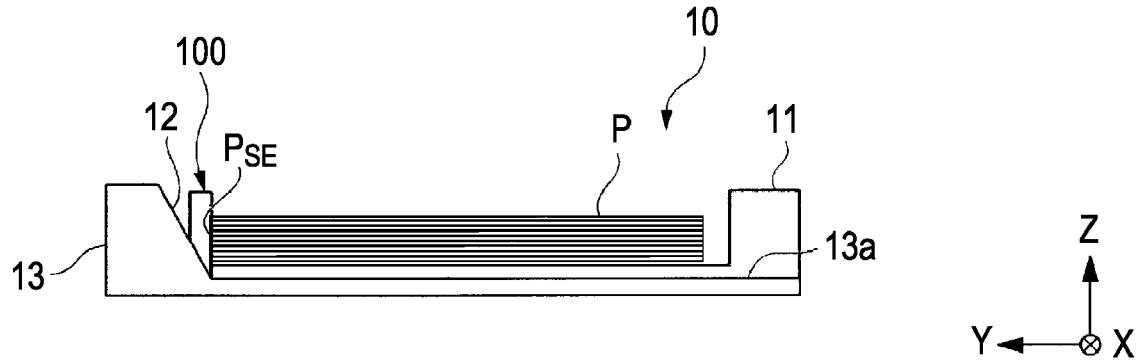
Figure 5C:
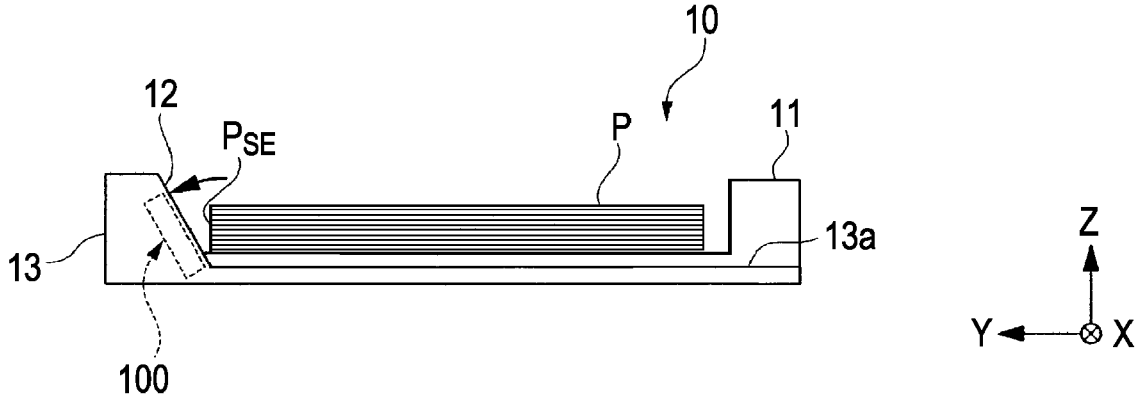
Figure 6A:
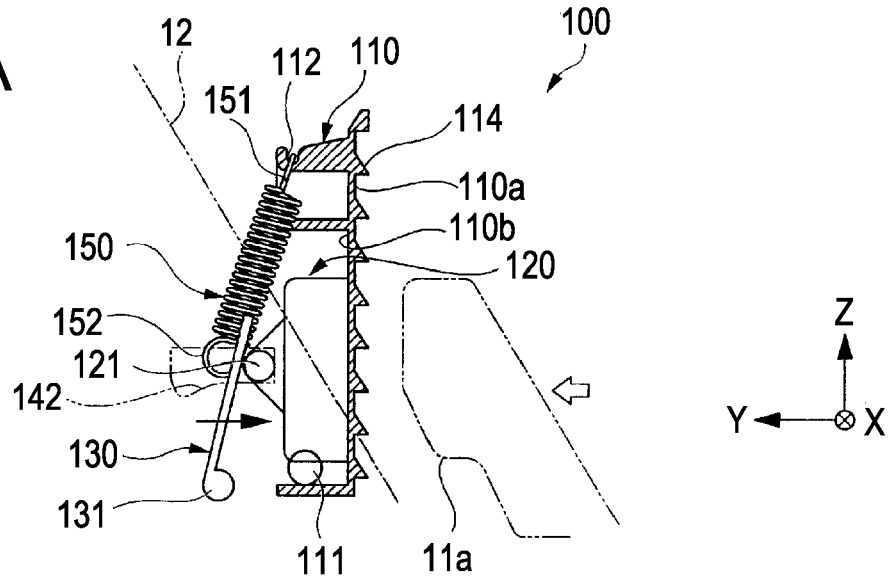
FIGS. 6A to 6C are views illustrating a rotational operation of a stopper from a standing state to a tilted state.
Figure 6B:
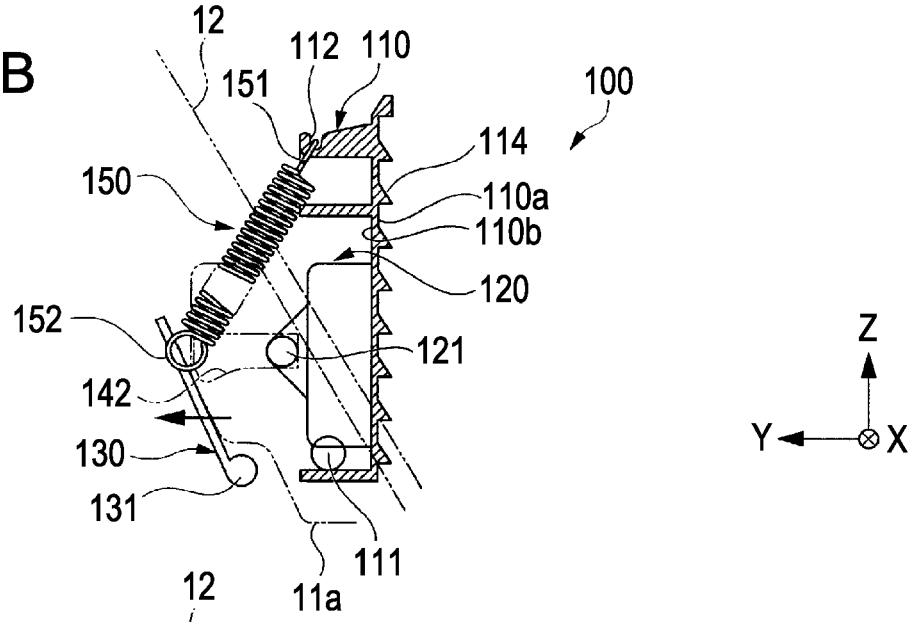
Figure 6C:
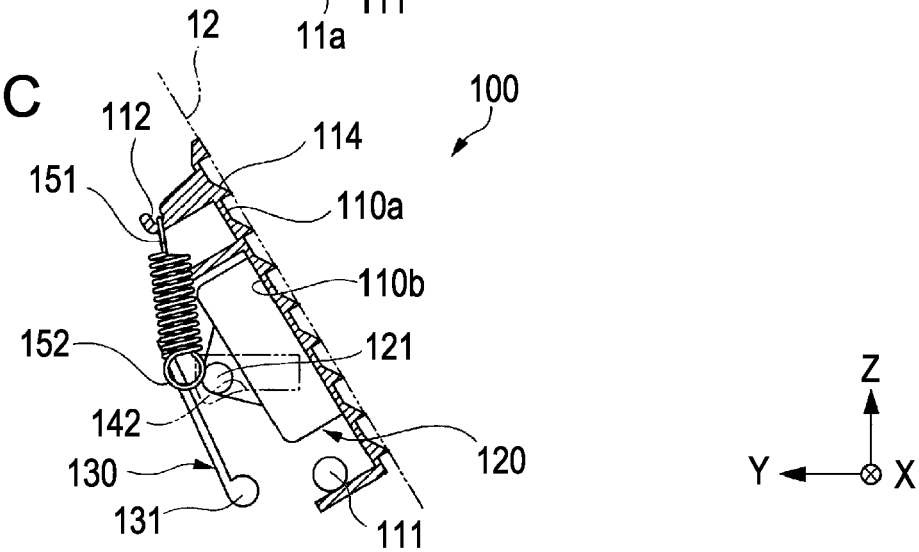

Next, the rotational operation of the regulation unit 100 according to the embodiment from the time before the side edges $P_{SE}$ of the sheets P are regulated to the time after the regulation of the side edges $P_{SE}$ of the sheets P is released is described with reference to FIGS. 5A to 5C and FIGS. 6A to 6C. FIGS. 5A to 5C are views illustrating a set state of sheets using the regulation unit 100. FIGS. 6A to 6C are views illustrating a rotational operation of the stopper 110 from the standing state to the tilted state. In FIGS. 5A to 5C, only the stacking apparatus 10 is shown for the convenience and other components constituting the recording apparatus 1 are not shown. Further, in FIGS. 6A to 6C, only the regulation unit 100 and the separation slope 12 are shown for the convenience and the base 140 constituting the regulation unit is not shown. However, in FIG. 6A and FIG. 6B, a part (convex 11*a*) of the cassette 11 is shown for the convenience.

At first, the cassette 11 on which a plurality of sheets P are stacked is mounted from a mounting port 13*a* of the mounting portion 13 in the +Y direction (see, FIG. 5A and FIG. 6A). At this time, the stopper 110 is in the standing state in which the surface 110*a* of the stopper 110 is perpendicular to the mounting direction Y of the sheets P.

To be more specific, the stopper 110 abuts against the base 140 while being supported by the stopper rotational shaft 111 as a supporting shaft. Further, the one end 151 of the coil spring 150 is fixed to the hook portion 112 provided on the upper end of the stopper 110. Further, the other end 152 of the coil spring 150 is fixed to the hook portion 133 provided on the lever 130. That is, a force of pulling to the side of the lever 130 is given to the stopper 110 by the coil spring 150 all the time.

At this time, a force is given to the lever 130 by the torsion spring 160 in the direction shown by a rightwards arrow (approximately in −Y direction) in FIG. 6A. That is, the lever 130 (to be more specific, the stay portion 135 as shown in FIG. 4) pushes the stopper 110 in the rightwards arrow direction in FIG. 6A. Therefore, the stopper 110 is not tilted (does not rotate about the stopper rotational shaft 111) and kept to be in the standing state.

Further, the slider 120 is arranged at the lower side (−Z direction side) of the stopper 110. In addition, the slider rotational shaft 121 is positioned at a right end (−Y direction side) of the cam 142.

Next, when the cassette 11 on which a plurality of sheets P are stacked is mounted on the mounting portion 13, the lever 130 (to be more specific, the reception portion 134 as shown in FIG. 4) is pushed by the convex 11*a* of the cassette 11 in the leftwards arrow direction in FIG. 6B (approximately in +Y direction) (see, FIG. 5B and FIG. 6B). Then, the stopper 110 is pulled by a force of the coil spring 150 because the stopper 110 is not pushed by the lever 130. The surface 110*a* of the stopper 110 is tilted from the standing state to the tilted state where the surface 110*a* is parallel with the separation slope 12. At this time, with the above-described damper mechanism, the stopper 110 rotates from the standing state to the tilted state with a timelag.

To be more specific, the stopper 110 is kept to be in the standing state immediately after the cassette 11 is mounted on the mounting portion 13. Therefore, even when the plurality of sheets P stacked on the cassette 11 move in the mounting direction (+Y direction) with impetus when the cassette 11 is mounted, the side edges $P_{SE}$ of the sheets P abut against the surface 110*a* of the stopper 110. Therefore, the sheets P do not run up the separation slope 12 and the side edges $P_{SE}$ of the sheets P are regulated. Then, the side edges $P_{SE}$ of the sheets P align in the Z direction along the surface 110*a* of the stopper 110. Thereafter, since the contact surface between the slider 120 and the stopper 110 functions as the above-described oil damper and friction damper, the stopper 110 is tilted slowly from the standing state to the tilted state with a timelag. At this time, the side edges $P_{SE}$ of the sheets P are kept to be aligned in the Z direction.

Then, the stopper 110 is pulled with a force of the coil spring 150 so as to be tilted to the tilted state where the surface 110*a* thereof is parallel with the separation slope 12 (see, FIG. 5C and FIG. 6C). At this time, the slider 120 is arranged at the upper end of the stopper 110. Further, the slider rotational shaft 121 is positioned at a left end of the cam 142 (+Y direction side).

The stopper 110 is retreated to an inner side with respect to the separation slope 12 when the stopper 110 rotates to be in the tilted state. To be more specific, all the plurality of convexes 114 provided on the surface 110*a* of the stopper 110 are accommodated in the inner side with respect to the separation slope 12 when the stopper 110 is tilted. Therefore, when the sheet P is transported, the sheet P is smoothly transported without being caught by the convexes 114.

Figure 7A:
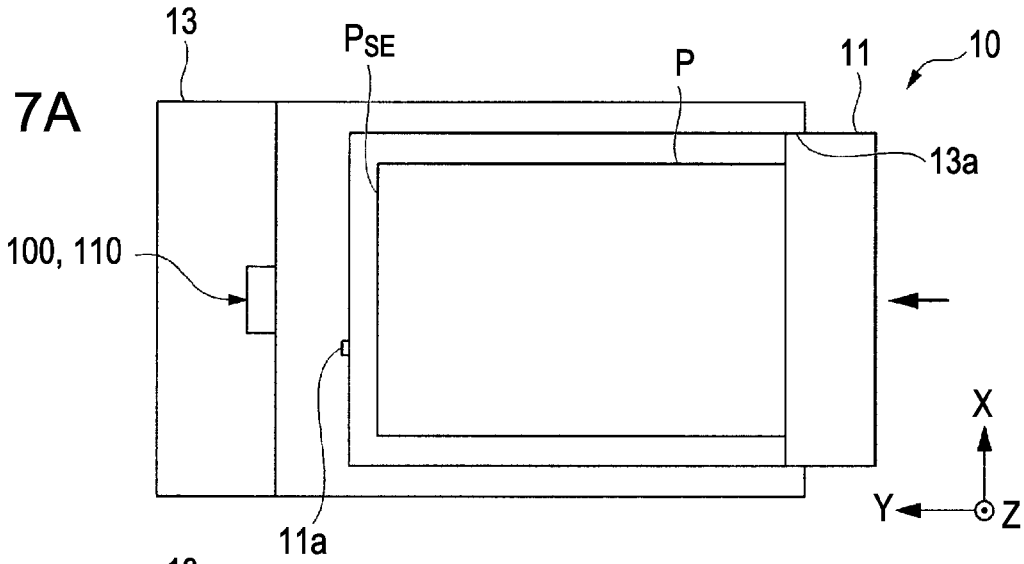
FIGS. 7A and 7B are plan views illustrating an arrangement state of the regulation unit.
Figure 7B:
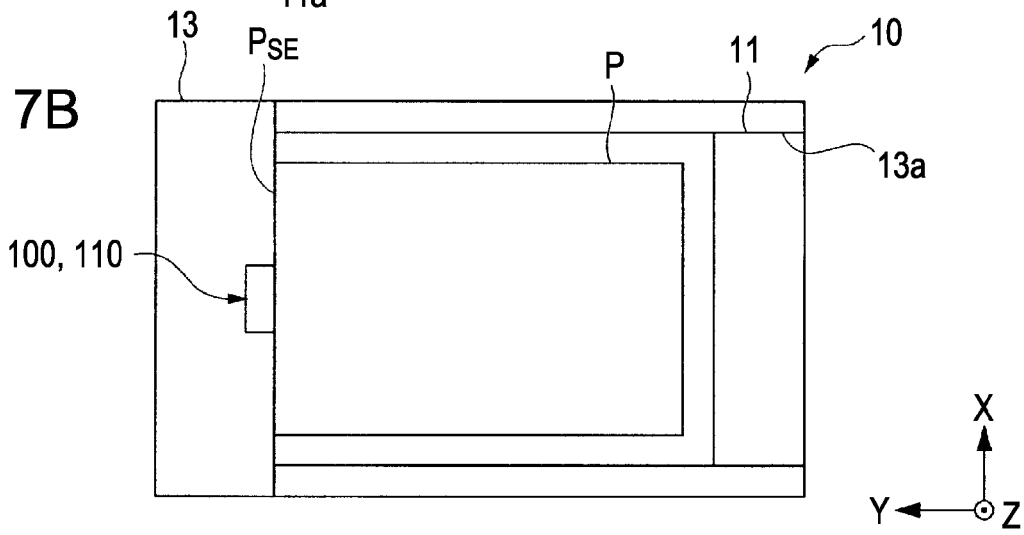

Next, an arrangement state of the regulation unit 100 according to the embodiment is described with reference to FIGS. 7A and 7B. FIGS. 7A and 7B are plan views illustrating an arrangement state of the regulation unit 100. In FIGS. 7A and 7B, only the stacking apparatus 10 is shown and other components constituting the recording apparatus 1 are not shown for the convenience.

As shown in FIGS. 7A and 7B, the regulation unit 100 (stopper 110) is provided at a center portion of the side edges $P_{SE}$ of the sheets P. To be more specific, one stopper 110 corresponds to the center portion of the side edges $P_{SE}$ of sheets P (center portion in the X direction) and is provided at the side of the mounting portion 13. Therefore, the side edges $P_{SE}$ of the sheets P can be stably regulated.

To be more specific, the cassette 11 on which the plurality of sheets P are stacked is mounted from the mounting port 13*a* of the mounting portion 13 in the +Y direction, at first (see, FIG. 7A and FIG. 7B). At this time, the plurality of the sheets P stacked on the cassette 11 move in the mounting direction (+Y direction) due to the impetus of mounting operation when the cassette 11 is mounted. Then, the center portion of the side edges $P_{SE}$ of the sheets P abuts against the stopper 110. Therefore, the collision energy of the sheets P against the stopper 110 uniformly acts on both the right side and the left side of the side edges $P_{SE}$ of the sheets P (positive side and negative side of the X direction) without being biased to any side. That is, the collision energy of the sheets P against the stopper 110 is absorbed by the above-described damper mechanism in a concentrated manner at the center portion of the side edges $P_{SE}$ (center portion in the X direction). Therefore, the side edges $P_{SE}$ of the sheets P can be stably regulated.

In the stacking apparatus 10, the transportation apparatus 5 and the recording apparatus 1 according to the embodiment, the stopper 110 is provided. The stopper 110 regulates the side edges $P_{SE}$ of the sheets P accommodated in the cassette 11 in the mounting direction (−Y direction) thereof when the cassette 11 is mounted on the mounting portion 13. Further, the stopper 110 releases the regulation of the side edges $P_{SE}$ of the sheets P with a timelag after the cassette 11 is mounted on the mounting portion 13. Therefore, the collision energy of the sheets P against the stopper 110 is absorbed with a timelag. That is to say, even when the cassette 11 is mounted roughly, the sheets P do not run up the separation slope 12 due to the impetus of mounting operation thereof. Accordingly, the cassette 11 can be mounted without requiring a user to be sensitive and the side edges $P_{SE}$ of the sheets P can be regulated. As a result, the stacking apparatus 10, the transportation apparatus 5 and the recording apparatus 1 having high reliability in which double feeding of the sheets P can be prevented and failures such as a sheet jam are suppressed from being caused can be provided.

Further, according to the configuration, since the surface 110*a* of the stopper 110 is subjected to the high friction processing, the sheets P do not easily run up the surface 110*a* of the stopper 110 in comparison with a case in which the surface 110*a* of the stopper 110 is not subjected to any processing. Accordingly, the cassette 11 can be mounted without requiring a user to be sensitive and the side edges $P_{SE}$ of the sheets P can be reliably regulated.

Further, according to the configuration, the stopper 110 rotates from the standing state where the surface 110*a* of the stopper 110 is perpendicular to the mounting direction Y of the sheets P to the tilted state where the surface 110*a* is parallel with the separation slope 12. That is, the stopper 110 rotates from the standing state before the side edges $P_{SE}$ are regulated to the tilted state after the regulation of the side edges $P_{SE}$ are released. Therefore, a configuration in which the stopper 110 is accommodated in a space where the separation slope 12 is formed can be employed. That is, unlike the configuration disclosed in Japanese Patent No. 3538569 in which a shutter member is rotationally moved and slid to the retreated position, spaces for providing the rotational mechanism and the sliding mechanism are not required. Further, spaces for accommodating the shutter member, the rotational mechanism and the sliding mechanism in the retreated position are not required. Accordingly, the apparatus can be reduced in size.

In addition, according to the configuration, when the stopper 110 rotates to the tilted state, the stopper 110 is retreated to the inner side with respect to the separation slope 12. To be more specific, all the plurality of convexes 114 provided on the surface 110*a* of the stopper 110 are accommodated in the inner side with respect to the separation slope 12 when the stopper 110 is tilted. Therefore, when the sheet P is transported, the sheet P is smoothly transported without being caught by the convexes 114.

Further, according to the configuration, the slider 120 is provided. The slider 120 moves in conjunction with the rotational operation of the stopper 110 and slides along the back surface 110*b* of the stopper 110 through the cam which converts the rotational operation of the stopper 110 to a linear movement. Therefore, a space can be effectively used in comparison with a case where the slider 120 is slid while a surface which is different from the back surface 110*b* of the stopper 110 (for example, a surface of the mounting portion 13 on which the cassette 11 is mounted (XY plane surface)) is set as a base surface. Accordingly, the apparatus can be reduced in size.

Further, according to the configuration, the first comb-tooth shape 115 is provided on the stopper 110 and the second comb-tooth shape 123 is provided on the slider 120. Therefore, an area where the slider 120 and the stopper 110 are in contact with each other becomes large. That is to say, when the slider 120 slides along the back surface 110*b* of the stopper 110, a high frictional force acts on the contact surface between the slider 120 and the stopper 110. Therefore, the contact surface between the slider 120 and the stopper 110 functions as a friction damper so that the collision energy of the sheets P against the stopper 110 is absorbed with a timelag. Accordingly, the cassette 11 can be mounted without requiring a user to be sensitive and the side edges $P_{SE}$ of the sheets P can be reliably regulated.

Further, according to the configuration, the viscous material 170 is arranged between the stopper 110 and the slider 120. Therefore, the contact surface between the slider 120 and the stopper 110 functions as an oil damper. With the configuration, the cassette 11 can be mounted without requiring a user to be sensitive and the side edges $P_{SE}$ of the sheets P can be reliably regulated, too.

Further, according to the configuration, the stopper 110 is provided at a center portion of the side edges $P_{SE}$ of the sheets P. Therefore, the collision energy of the sheets P against the stopper 110 uniformly acts on both the right side and the left side of the side edges $P_{SE}$ of the sheets P without being biased to any side. That is, the collision energy of the sheets P against the stopper 110 is absorbed by the above-described damper mechanism in a concentrated manner at the center portion of the side edges $P_{SE}$. Therefore, the side edges $P_{SE}$ of the sheets P can be stably regulated.

Note that although only one stopper 110 is provided at the center portion of the side edges $P_{SE}$ of the sheets P in the embodiment, the number of the stoppers 110 is not limited to one. For example, a plurality of stoppers 110 may be provided along the side edges $P_{SE}$ of the sheets P. Hereinafter, a stacking apparatus 10A according to an embodiment different from the above embodiment is described with reference to FIG. 8.

MODIFICATION 1

Figure 8:
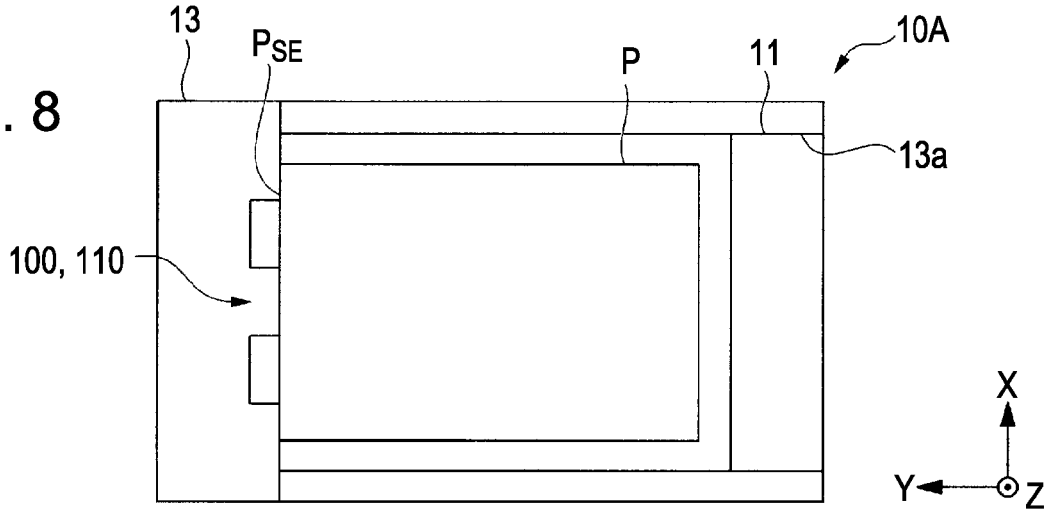
FIG. 8 is a plan view illustrating an arrangement state of a regulation unit of a first modification.

FIG. 8 is a plan view illustrating an arrangement state of the regulation unit 100 in the stacking apparatus 10A according to an embodiment different from the above embodiment. FIG. 8 is a plan view illustrating the arrangement state of the regulation unit 100 corresponding to FIG. 7B in the stacking apparatus 10A. In FIG. 8, similar reference numerals denote similar components in FIG. 7B and the detail description is not repeated.

As shown in FIG. 8, a plurality of stoppers 110 are provided along the side ends of the side edges $P_{SE}$ of the sheets P. To be more specific, the stoppers 110 correspond to the right side and the left side of the side edges $P_{SE}$ of the sheets P and two stoppers 110 are provided at the side of the mounting portion 13. Therefore, the edges $P_{SE}$ of the sheets P can be stably regulated.

To be more specific, when the plurality of sheets P stacked on the cassette 11 move in the mounting direction (+Y direction) with impetus when the cassette 11 is mounted, the side edges $P_{SE}$ of the sheets P abut against the two stoppers 110. Therefore, the collision energy of the sheets P against each stopper 110 uniformly acts on both the right side and the left side of the side edges $P_{SE}$ of the sheets P (positive side or negative side in the X direction). That is, the collision energy of the sheets P against the stopper 110 is absorbed by the above-described damper mechanisms in a dispersed manner at the right side and the left side of the side edges $P_{SE}$. Therefore, the side edges $P_{SE}$ of the sheets P can be reliably and stably regulated.

Further, although in the Modification, two stoppers 110 are provided along the side ends of the side edges $P_{SE}$ of the sheets P, the number of stoppers is not limited to two. For example, three or four stoppers 110 may be provided along the side ends of the side edges $P_{SE}$ of the sheets P. That is, it is sufficient that a plurality of stoppers may be provided along the side ends of the side edges $P_{SE}$ of the sheets P and the number of the stoppers installed can be appropriately changed depending on the necessity.

What is claimed is:

1. A stacking apparatus comprising:

a cassette which accommodates a plurality of recording media in a superimposed manner;

a mounting portion on which the cassette is mounted;

a transportation path which is arranged at a downstream side in a direction in which the cassette is mounted on the mounting portion and on which the recording media are transported from the cassette mounted on the mounting portion;

a stopper of which surface for regulating downstream side edges of the recording media regulates the side edges until the cassette is mounted on the mounting portion and of which surface for regulating the side edges of the recording media releases the regulation of the side edges with a rotational operation after the cassette is mounted on the mounting portion, wherein a first comb-tooth shape is provided on a back surface of the regulating surface of the stopper for regulating the side edges and a second comb-tooth shape which engages with the first comb-tooth shape is provided on a surface of the slider at a side opposed to the stopper; and a slider which slides along a back surface of the regulating surface of the stopper for regulating the side edges.

2. The stacking apparatus according to claim 1, wherein a viscous material is arranged between surfaces of the stopper and the slider, which are opposed to each other.

3. The stacking apparatus according to claim 2, wherein the surface of the stopper for regulating the side edges is subjected to a high friction processing.

4. The stacking apparatus according to claim 3, wherein the stopper is provided at a position corresponding to a center portion of the side edges in an extension direction of the side edges.

5. The stacking apparatus according to claim 4, wherein a plurality of stoppers are provided so as to be parallel with the extension direction of the side edges.

6. A transportation apparatus comprising:

a cassette which accommodates a plurality of recording media in a superimposed manner;

a mounting portion on which the cassette is mounted;

a transportation path which is arranged at a downstream side in a direction in which the cassette is mounted on the mounting portion and on which the recording media are transported from the cassette mounted on the mounting portion;

a stopper of which surface for regulating downstream side edges of the recording media regulates the side edges until the cassette is mounted on the mounting portion and of which surface for regulating the side edges of the recording media releases the regulation of the side edges with a rotational operation after the cassette is mounted on the mounting portion, wherein a first comb-tooth shape is provided on a back surface of the regulating surface of the stopper for regulating the side edges and a second comb-tooth shape which engages with the first comb-tooth shape is provided on a surface of the slider at a side opposed to the stopper; and a slider which slides along a back surface of the regulating surface of the stopper for regulating the side edges; and a transportation roller which transports the recording media transported from the stacking apparatus.

7. A recording apparatus comprising:

a cassette which accommodates a plurality of recording media in a superimposed manner;

a mounting portion on which the cassette is mounted;

a transportation path which is arranged at a downstream side in a direction in which the cassette is mounted on the mounting portion and on which the recording media are transported from the cassette mounted on the mounting portion;

a stopper of which surface for regulating downstream side edges of the recording media regulates the side edges until the cassette is mounted on the mounting portion and of which surface for regulating the side edges of the recording media releases the regulation of the side edges with a rotational operation after the cassette is mounted on the mounting portion, wherein a first comb-tooth shape is provided on a back surface of the regulating surface of the stopper for regulating the side edges and a second comb-tooth shape which engages with the first comb-tooth shape is provided on a surface of the slider at a side opposed to the stopper;

a slider which slides along a back surface of the regulating surface of the stopper for regulating the side edges;

a transportation roller which transports the recording media transported from the stacking apparatus; and a recording portion which performs a recording processing on the recording media transported by the transportation apparatus.

* * * * *